US005645090A

United States Patent [19]

Juhl et al.

[11] Patent Number: 5,645,090

[45] Date of Patent: Jul. 8, 1997

[54] DEVICE, KIT AND METHOD OF APPLYING POLISH TO TIP OF NAIL

[75] Inventors: Kathryn A. Juhl; S. Rozan Christian, both of Dallas; Max L. Christian, Sherman County; Clarence Zierhut, Dallas County, all of Tex.

[73] Assignee: Juhl, Christian and Christian, Inc., Dallas, Tex.

[21] Appl. No.: 430,380

[22] Filed: Apr. 28, 1995

Related U.S. Application Data

[63] Continuation-in-part of Ser. No. 410,335, Mar. 24, 1995.

[51] Int. Cl.[6] ..... A45D 29/00

[52] U.S. Cl. ..... 132/285; 132/73; 132/76.2; 132/76.5; 132/319

[58] Field of Search ..... 132/285, 73, 76.2, 132/73.5, 75, 313, 319; 2/21; 206/581, 823, 229

[56] References Cited

U.S. PATENT DOCUMENTS

| | | | |
|---|---|---|---|
| 3,245,418 | 4/1966 | Dinerstein | 132/285 |
| 3,258,018 | 6/1966 | Tinsley | 132/285 |
| 3,382,878 | 5/1968 | Dinerstein | 132/285 |
| 3,592,202 | 7/1971 | Jones | 132/313 |
| 4,577,648 | 3/1986 | Dinerstein et al. | 132/73 |
| 5,450,864 | 9/1995 | LaJoie et al. | 132/73 |
| 5,513,754 | 5/1996 | Chang | 206/581 |

*Primary Examiner*—Gene Mancene
*Assistant Examiner*—Pedro Philogene
*Attorney, Agent, or Firm*—Winstead Sechrest & Minick P.C.; Lisa H. Meyerhoff

[57] ABSTRACT

A device, kit and method used in applying polish to a finger nail for obtaining a french manicure. The device can be removably engaged around a finger tip to establish a line of demarcation that approximates the curve of the tip of the finger nail. This line of demarcation allows an individual to apply a band of finger nail polish along the tip of the finger nail, while preventing the polish from contacting the portion of the finger nail away from the fingertip. The device is sufficiently flexible to be deflected from a nail-engaging position to a removing position when a force is applied against opposed sides of the device. The disclosed kit includes one or more of these devices, a container of finger nail polish and an applicator to apply the finger nail polish.

4 Claims, 1 Drawing Sheet

DEVICE, KIT AND METHOD OF APPLYING POLISH TO TIP OF NAIL

CROSS-REFERENCE TO RELATED APPLICATIONS

This application is a continuation-in-part of application Ser. No. 08/410,335, filed on Mar. 24, 1995, entitled: Device, Kit and Method of Caring for a Finger Nail, now pending.

TECHNICAL FIELD

This invention relates to a device, kit and method used in applying polish to a finger nail and, more particularly, to a device, a kit and a method used in applying polish to a finger nail for obtaining a french manicure.

BACKGROUND ART

The caring for finger nails is well known. One of the methods used to care for finger nails is a french manicure that accentuates the white that naturally appears at the tip of the natural nail. This method involves applying a white or off-white polish in a uniform line at the tip of the nail while not applying such polish to the remainder of the nail. The remainder of the nail is that portion extending from the tip of the nail to the cuticle of the nail.

One method of obtaining a french manicure is by employing a highly skilled manicurist. A highly skilled manicurist is required because not all manicurists are capable of applying the polish along a uniform line at the exact location. Even though some manicurists believe that they possess the requisite skills to provide a french manicure, they fail. It then becomes necessary to remove the polish at the tip and apply polish in a conventional manicure. Accordingly, obtaining a french manicure from a manicurist is difficult, if not impossible, time consuming and expensive.

Also, a french manicure may be obtained by attaching masking tape to the tip of a nail before applying polish to the tip. The polish is then applied to the nail and tape with the tape being removed after the polish dries. This procedure may be accomplished by using a kit, such as that sold by Orly International Inc. under the name ORLY French Manicure. However, because the polish dries simultaneously on the tape and along the tip of the nail, a portion of the polish along the tip may be removed with the tape, which causes irregularities along the line of demarcation between the polish and no polish formed in the french manicure. When this occurs, the polish must be removed, new tape applied and the polish re-applied. The application of the masking tape is time consuming and the demarcation line of the manicure is not regular and is not as attractive as one desires.

A recent development has been a device that includes a body having a size sufficient to prevent polish from being applied to a shielded portion of the finger nail away from the tip. A passageway extends through the body and has a size sufficient to receive the tip of the nail on one side of the body and allow access by a user of the device to the tip of the nail on the other side of the body.

Another recent development has been a kit adapted for applying polish to a tip of a finger nail. The kit includes a device having a body with a size sufficient to prevent polish from being applied to a shielded portion of the finger nail away from the tip. A passageway extends through the body and has a size sufficient to receive the tip of the nail on one side of the body and allow access by a user of the device to the tip of the nail on the other side of the body. The kit also includes a container of finger nail polish and an applicator to apply the polish to the tip of the nail after a finger is secured to the device to permit an individual to obtain a french type manicure.

Another recent development has been a method of applying polish to a tip of a finger nail. A device is constructed that has a body made to expose the tip of the nail while shielding the remainder of the nail. The nail is positioned in the device to expose the tip while preventing access of the polish to the remainder of the nail. Polish is then applied to the tip of the nail.

The last three recent developments described above are disclosed in application Ser. No. 08/410,375 and the disclosure contained therein is incorporated herein by reference.

Accordingly, it is an object of the present invention to provide a device that is used when applying polish to a tip of a finger nail to obtain a french manicure and is easier to use than previous devices.

Further, it is an object of the present invention to provide a kit that is adapted for applying polish to a tip of a finger nail to obtain a french manicure and is easier to use than previous devices.

Further, it is an object of the present invention to provide a method of applying polish to a tip of a finger nail to obtain a french manicure and is easier to accomplish than previous methods.

DISCLOSURE OF THE INVENTION

In accordance with the present invention there is provided a device used for applying a polish to a tip of a finger nail and to prevent the application of the polish to another portion of the nail. The device comprises a thin walled shielding portion that is sufficiently flexible to be deflected from a nail engaging position to a removing position when a force is applied against opposed sides of said shielding portion. The shielding portion has a size sufficient to prevent the polish from contacting a portion of the nail away from the tip, and a demarcation shoulder formed along an edge to provide a line of demarcation along which the polish exists on one side and does not exist on the other side. Apparatus detachably connects the shielding portion to a finger with a nail to which the polish is applied to the tip.

Further, in accordance with the present invention there is provided a kit adapted for applying a polish to a tip of a finger nail. The kit comprises a device used for applying the polish to a tip of a finger nail and to prevent the application of the polish to another portion of the nail. The device includes a thin walled shielding portion that is sufficiently flexible to be deflected from a nail engaging position to a removing position when a force is applied against opposed sides of said shielding portion. The shielding portion has a size sufficient to prevent the polish from contacting a portion of the nail away from the tip, and a demarcation shoulder formed along an edge to provide a line of demarcation along which the polish exists on one side and does not exist on the other side. Apparatus detachably connects the shielding portion to a finger with a nail to which the polish is applied to the tip. A container of finger nail polish and an applicator to apply the polish to the tip of the nail after a finger is secured to the device.

Further, in accordance with the present invention there is provided a method of obtaining a french manicure on a tip of a nail of a finger. The method comprises the steps of constructing a device having a thin walled body with an edge approximating a curve of an end of the finger to which the nail is to be polished and apparatus for detachably connecting the thin walled body to the finger. The thin walled body is positioned on the finger with the curved edge facing the end of the finger and disposed down the nail away from the tip of the nail. The polish is applied to the tip of the nail. The device is deformed sufficiently to remove the device from the finger without contacting the polish applied to the tip. The polish is then allowed to dry.

BRIEF DESCRIPTION OF THE DRAWINGS

Other objects and advantages of the invention will become apparent upon reading the following detailed description and upon reference to the drawings, wherein like reference characters are used throughout to designate like parts.

BEST MODE FOR CARRYING OUT THE INVENTION

Figure 1:
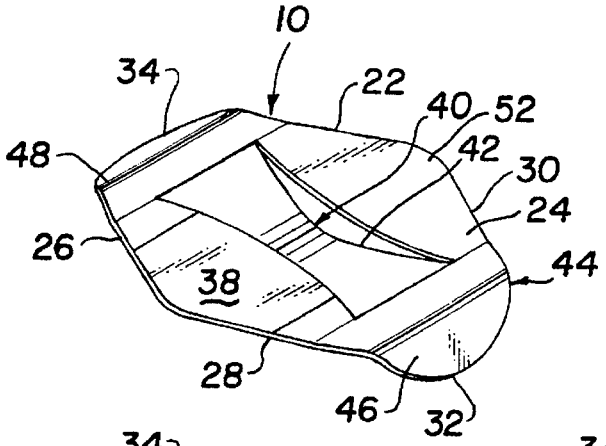
FIG. 1 is a perspective view of a device constructed according to the present invention.

Turning now to the drawings, there is shown a device 10 constructed according to the present invention. Device 10 is secured to a finger 12 and used when applying a polish 14 to a tip 16 of a nail 18 grown at the end 20 of finger 12.

Figure 4:
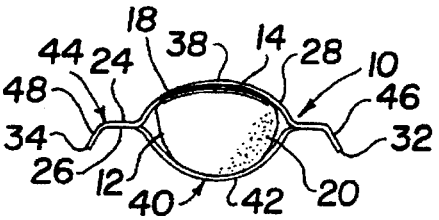
FIG. 4 is an end view of the device shown in FIG. 3 when in a nail engaging position to apply the polish to the nail.
Figure 5:
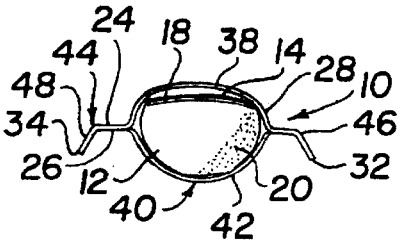
FIG. 5 is art end view of the device shown in FIG. 3 after being deflected to a removing position so as to remove the device from a finger after the polish has been applied to the nail and before the polish has dried.
Figure 6:
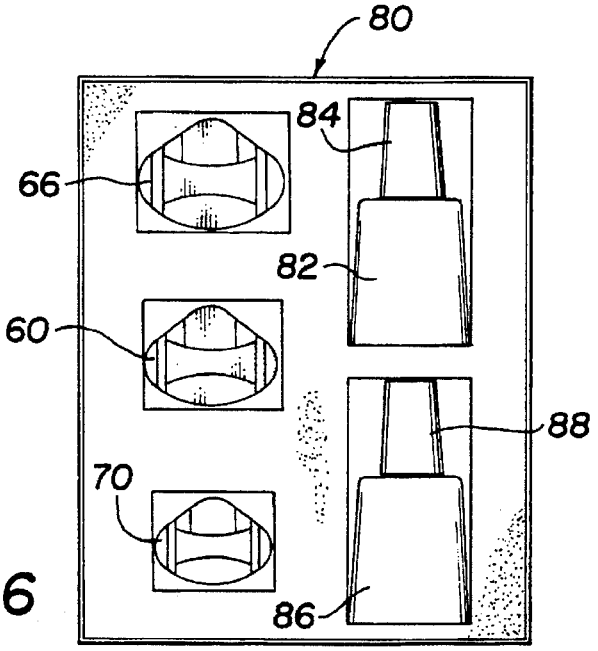
FIG. 6 is a plan view of a multiplicity of the devices shown in FIG. 1 provided in a kit to allow a french manicure to nails on different sized fingers.

Device 10 has a thin walled body 22 with a generally oval shape that is defined by a top 24, a bottom 26, a front edge 28, a back edge 30, a left edge 32 and a right edge 34. Body 22 is sufficiently thin and made from a plastic selected to provide flexibility sufficient to be deflected from a nail engaging position, as best seen in FIG. 4, to a removing position, as best seen in FIG. 5, when a force is properly applied.

Along front edge 28 of body 22 is a shoulder 36 that engages nail 18 in close proximity to tip 16 and will after polish 14 is applied form a line of demarcation that is substantially coincident with shoulder 36 so that polish 14 exists on one side (the side nearest tip 16) and not exist on the other side (the side away from tip 16). This demarcation shoulder 36 is curved to generally parallel end 20 of finger 12.

A shielding portion 38 is provided in body 22 that extends away from shoulder 36 toward back edge 30 for a distance sufficient to shield that portion of nail 18 to which polish is not being applied. This distance and the space between edges 32 and 34 provides an area with a size sufficient to prevent the polish from contacting the other portion of the nail away from tip 16. To ensure a good contact of body 22 with nail 18, shielding portion 38 is deformed with a convex curve extending along a cylindrical axis lying substantially parallel to elongate axis 50 of finger 12. Also, shielding portion 38 is constructed to slope upwardly away from shoulder 36 when going toward back edge 30 to further ensure a good contact between shoulder 36 and nail 18.

An apparatus 40 for detachably connecting shielding portion 38 to finger 12 is also provided in body 22. Apparatus 40 includes a belt-like member 42 that is connected to shielding portion 38, as best seen in FIG. 1. Belt-like member 42 has a size sufficient to permit the finger to extend therethrough, as best seen in FIGS. 2 and 3.

To receive the force applied against the opposed sides of body 22 is a shoulder apparatus 44. Shoulder apparatus 44 includes a left shoulder 46 disposed inwardly from left edge 32 and a right shoulder 48 disposed inwardly from right edge 34. Shoulders 46 and 48 are provided in body 22 by bending edges 32 and 34 of body 22 in the same direction toward bottom 26 of body 22 to form angled shoulders. The angle of shoulders 46 and 48 is such that body 22 assists in moving shielding portion above nail 18 when the force is applied against shoulders 46 and 48 in a diametrically opposed direction. Top 24 of each shoulder 46 and 48 is disposed to extend in its respective plane that extends generally parallel to elongate axis 50 of finger 12 so that shoulders 46 and 48 are provided in body 22 on diametrically opposed sides of shielding portion 38.

A securing portion 52 of body 22 assists in securing body 22 to finger 12. Securing portion 52 is disposed in body 22 along the side of detachably connecting apparatus 40 away from shielding portion 38 and is deformed in an arcuate shape to extend with an axis lying substantially parallel to elongate axis 50. When finger 12 extends beneath securing portion 52, through belt-like member 42 of finger connecting apparatus 40 and beneath shielding portion 38, securing portion 52 acts to force body 22 into a more secure connection with finger 12 than is possible without securing portion 52.

Figure 2:
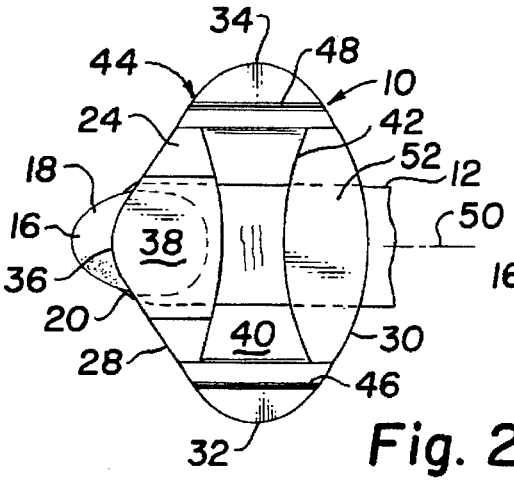
FIG. 2 is a plan view of the device shown in FIG. 1 after being secured to a finger and just prior to applying polish to the nail of the finger.
Figure 3:
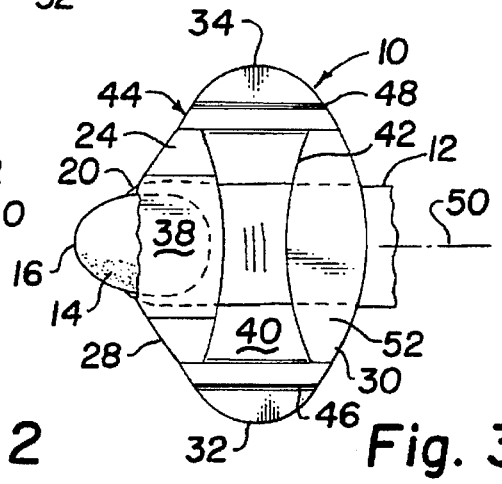
FIG. 3 is a plan view of the device shown in FIG. 1 after the polish has been applied to the nail.

A french manicure with a polish demarcation line generally paralleling shoulder 36 is obtained by moving finger 12 beneath bottom 26 of securing portion 52, through belt-like member 42 of finger connecting apparatus 40 and beneath bottom 26 of shielding portion 38 so that tip 16 of nail 18 extends past the edge of shielding portion 38, as best seen in FIG. 2. If desired, a force, such as that provided by the fingers on the other hand of a user, is exerted against shoulders 46 and 48 to cause shielding portion 38 of body 22 to be deflected to the non-engaging position, while finger 12 is being moved to the position shown in FIG. 2. After finger 12 is in the position shown in FIG. 2, polish 14 is applied by a brush or similar applicator moved across device 10 to tip 16 of nail 18.

The material and dimensions used to construct body 22 are chosen so that body 22 is sufficiently flexible to allow removal of body 22 from finger 12 without contacting polish 14 applied to nail 16 by moving or squeezing opposed left shoulder 46 and right shoulder 48 toward one another and moving body 22 over tip 16 and end 20 of finger 12 without contacting polish 14.

It has been discovered that at least three devices 60, 66 and 70 should be used in a kit 80 to provide a french manicure that approximates the curvature of the end of a finger 12 to each finger of the hand of the user. Therefore, kit 80 includes three devices 60, 66 and 70, and a first container 82 of finger nail polish that is white, off-white or similarly colored, and an applicator 84, such as a brush connected to the top and disposed within container 82, to apply the polish to tip 14 of nail 16 after finger 12 is secured to device 60, 66 or 70, as previously explained in relation to device 10. If desired, a second container 86 is provided with an applicator 88, such as a brush connected to the top and disposed within container 86, to apply an over coat to the first coat of polish.

In kit 80, device 60 is sized to be of a medium size that allows two or three fingers to have polish 14 applied with the line of demarcation generally paralleling end 20 of finger 12 for each finger. Device 66 is sized to be of a small size that allows one or two fingers to have polish 14 applied with the line of demarcation generally paralleling end 20 of finger 12 for each finger. It has been discovered that this small size will provide acceptable results when the dimensions are down sized by about 20% or about 80% of device 60. Device 70 is sized to be of a large size that allows one or two fingers to have polish 14 applied with the line of demarcation generally paralleling end 20 of finger 12 for each finger. It has been discovered that this large size will provide acceptable results when the dimensions are up sized by about 20% or about 120% of device 60.

In operation, a user removes first container 82 from kit 80 and device 60, 66 or 70. The cap of first container 82 would be loosened. If nail 18 of the little finger of the user is to be polished, device 66 is removed from kit 80. Opposed shoulders 46 and 48 of device 66 would be squeezed between the fingers on one hand of the user to the removing position for shielding portion 38. The little finger, as represented by finger 12, on the other hand of the user would be positioned with tip 16 properly aligned with demarcation shoulder 36. The cap of first container 82 is to expose the applicator and the polish applied as previously explained. If device 66 provides the correct curvature for the ring finger, then device 66 is positioned as previously explained and polish applied to tip 16 of the nail of the user. If device 66 does not provide the correct curvature, then device 60 is removed from kit 80 and used as previously explained. In like manner, polish 14 is applied to all of the fingers of the hands of the user. After the polish dries, second container 86 is removed from kit 80 and an over coat applied to tips 16 of each nail 18, as previously explained.

The invention having been described, what is claimed is:

1. A device used for applying a polish to a tip of a finger nail and to prevent the polish from being applied to another portion of the nail, said device comprising:

a thin-walled body, said thin walled body including:

a shielding portion disposed at one end of said thin-walled body, said shielding portion having a size sufficient to prevent the polish from contacting the other portion of said finger nail away from the tip of said nail, said shielding portion further including a deformation section having a convex curve extending along a cylindrical axis, the cylindrical axis being disposed to extend substantially parallel to an elongate axis of the finger;

a demarcation shoulder disposed along an edge of said shielding portion, said demarcation shoulder interacting with said finger nail to form a line of demarcation along which the polish exists on the nail on one side of the demarcation shoulder and does not exist on the nail on the other side of the demarcation shoulder:

a first shoulder extending from a first side of said shielding portion in a first plane that is substantially parallel to the elongate axis of a finger to which said shielding portion is detachably connected; and a second shoulder extending from a second side of said shielding portion in a second plane that is substantially parallel to the elongate axis of the finger to which said shielding portion is detachably connected, wherein said first and said second shoulders are on diametrically opposed sides of said shielding portion; and means for detachably connecting said shielding portion to said finger having said finger nail to which said polish is applied to the tip, said connecting means including a belt-shaped member attached to said shielding portion on a side opposite to said demarcation shoulder, the belt-shaped member having a size sufficient to permit the finger to extend therethrough:

wherein said shielding portion is sufficiently flexible to be deflected from a nail engaging position to a removing position when a force is applied against opposed first and second sides of said shielding portion.

2. The device as set forth in claim 1, wherein said thin-walled body further comprises a securing portion, said securing portion attached to said detachably connecting means on a side opposite said shielding portion, said securing portion aiding in securing said thin-walled body to the finger.

3. A kit adapted for applying polish to a tip of a finger nail, said kit comprising:

a device used for applying a polish to a tip of a finger nail and to prevent the polish from being applied to another portion of the nail, said device comprising:

a thin walled body, said thin walled body including:

a shielding portion disposed at one end of said thin-walled body, said shielding portion having a size sufficient to prevent the polish from contacting the other portion of said finger nail away from the tip of said nail, said shielding portion further including a deformation section having a convex curve extending along a cylindrical axis, the cylindrical axis being disposed to extend substantially parallel to an elongate axis of the finger;

a demarcation shoulder disposed along an edge of said shielding portion, said demarcation shoulder interacting with said finger nail to form a line of demarcation along which the polish exists on the nail on one side of the demarcation shoulder and does not exist on the nail on the other side of the demarcation shoulder;

a first shoulder extending from a first side of said shielding portion in a first plane that is substantially parallel to the elongate axis of a finger to which said shielding portion is detachably connected; and a second shoulder extending from a second side of said shielding portion in a second plane that is substantially parallel to the elongate axis of the finger to which said shielding portion is detachably connected, wherein said first and said second shoulders are on diametrically opposed sides of said shielding portion; and means for detachably connecting said shielding portion to said finger having said finger nail to which said polish is applied to the tip, said connecting means including a belt-shaped member attached to said shielding portion on a side opposite to said demarcation shoulder, the belt-shaped member having a size sufficient to permit the finger to extend therethrough;

wherein said shielding portion is sufficiently flexible to be deflected from a nail-engaging position to a removing position when a force is applied against opposed first and second sides of said shielding portion;

a container of finger nail polish; and an applicator to apply the polish to the tip of the nail after a finger is secured to said device.

4. The kit as set forth in claim 3, wherein said thin-walled body further comprises a securing portion, said securing portion attached to said detachably connecting means on a side opposite said shielding portion, said securing portion aiding in securing said thin walled body to the finger.

* * * * *